US007648593B2

(12) United States Patent
Pandey

(10) Patent No.: US 7,648,593 B2
(45) Date of Patent: Jan. 19, 2010

(54) ALUMINUM BASED ALLOY

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/285,481

(22) Filed: Nov. 21, 2005

(65) Prior Publication Data

US 2006/0093512 A1 May 4, 2006

Related U.S. Application Data

(63) Continuation-in-part of application No. 10/342,839, filed on Jan. 15, 2003, now abandoned.

(51) Int. Cl.
*C22C 21/06* (2006.01)

(52) U.S. Cl. ..... 148/440; 148/415; 420/543; 420/552

(58) Field of Classification Search ..... 148/440, 148/415; 420/543, 552
See application file for complete search history.

(56) References Cited

U.S. PATENT DOCUMENTS 4,874,440 A * 10/1989 Sawtell et al. ..... 148/437
5,055,257 A 10/1991 Chakrabarti et al.
5,624,632 A 4/1997 Baumann et al.
6,248,453 B1 6/2001 Watson
6,974,510 B2 * 12/2005 Watson ..... 148/437
2006/0093512 A1 5/2006 Pandey

OTHER PUBLICATIONS

'Aluminum and Aluminum alloys', ASM International, 1993, p. 559.*

Pandey A. B. et al., "High strength discontinuously reinforced aluminum for rocket applications" Database CA [Online] Chemical Abstracts Service, Columbus, Ohio, US; 2 pages Feb. 18, 2004, XP002426103 retrieved from STN Database accession No. 2004:130606 *abstract*.

* cited by examiner

*Primary Examiner*—Roy King
*Assistant Examiner*—Janelle Morillo
(74) *Attorney, Agent, or Firm*—Bachman & LaPointe, P.C.

(57) ABSTRACT

An aluminum alloy comprising Al, Sc, Gd, Zr, and optionally Mg. The aluminum alloy is strengthened by an aluminum solid solution matrix and a dispersion of $Al_3X$ precipitate having an $L1_2$ structure where X comprises Sc, Gd and Zr. Mg is a preferred addition to the alloy containing Gd and Zr. The alloying additions control strengthening and coarsening kinetics of the alloy through control of diffusivity in the aluminum matrix and coherency strain of the $Al_3X$ precipitate.

4 Claims, No Drawings

ALUMINUM BASED ALLOY

CROSS-REFERENCE TO RELATED APPLICATION

This application is a continuation-in-part of application Ser. No. 10/342,839 filed Jan. 15, 2003, abandoned.

BACKGROUND OF THE INVENTION

The present invention relates to an aluminum based alloy having excellent mechanical properties and suitable for applications in temperature ranges between −420° F. to 573° F.

Aluminum alloys have been used in aerospace and space applications owing to their good combination of strength, ductility and density. Aluminum alloys are, however, limited in their use at temperatures above 300° F. as most aluminum alloys at these elevated temperatures lose their strength due to rapid coarsening of strengthening precipitates.

There has been considerable effort in the prior art to improve the high temperature strength of aluminum alloys up to and exceeding 500° F. Prior attempts to improve the high temperature mechanical properties of aluminum alloys have included (a) aluminum-iron and aluminum-chromium based alloys that contain incoherent dispersoids and (b) mechanically alloyed pure aluminum and aluminum alloys strengthened by incoherent oxide particles. The strength of the aluminum alloys provided from approach (a) above tended to degrade at high temperatures due to coarsening of incoherent dispersoids. In addition, these aluminum alloys exhibited lower ductility and fracture toughness due to large volume fraction of incoherent particles. Accordingly, these alloy systems have not found widespread applications particularly with respect to high temperature environments. Some of the alloys considered for approach (b) included commercially pure aluminum, Al—Mg and Al—Ti produced using mechanical alloying processes. While these aluminum alloys showed promising strengths at high temperature, these alloys did not find widespread applications in high temperature environments possibly due to lower ductility and fracture toughness. See also U.S. Pat. No. 3,816,080. U.S. Pat. No. 6,248,453 discloses Al—Sc based alloys which contain high volume fractions of strengthening coherent dispersoids. While these alloys are useful at high temperatures, we would prefer a material with higher ductility and fracture toughness. Furthermore, the problem vis-à-vis low ductility and fracture toughness will be increased at cryogenic temperatures.

None of the prior approaches provides an aluminum alloy having excellent mechanical properties in the temperature range of −420° F. and 573° F.

Accordingly, it is the principle object of the present invention to provide an aluminum alloy having excellent mechanical properties and suitable for applications in temperature ranges of −420° F. to 573° F.

SUMMARY OF THE INVENTION

According to the present invention the foregoing object is obtained by providing an aluminum alloy comprising aluminum (Al), scandium (Sc), gadolinium (Gd), zirconium (Zr), and preferably magnesium (Mg). The aluminum alloy is characterized by an aluminum solid solution matrix and a dispersion of $Al_3X$ having an $L1_2$ structure where X comprises Sc, Gd and Zr. The alloy of the present invention can be produced by any rapid solidification technique that includes melt spinning, atomization, spray deposition, mechanical alloying and cryomilling.

In accordance with the present invention, it has been found that Gd and Zr are excellent alloying elements in addition to Sc to produce thermally stable microstructures based on their low diffusivities and solid solubilities in aluminum. The additions of Gd and Zr also help in controlling strengthening and coarsening kinetics through control in lattice constant of $Al_3Sc$ precipitate by substitution of Gd and Zr as $Al_3$(Sc,Gd, Zr). Gd and Zr have considerable solubilities in $Al_3Sc$ $L1_2$ precipitate. Magnesium is, preferably, added to increase the lattice constant of aluminum and also provides considerable solid solution strengthening in aluminum. It has been found that when lattice constants of aluminum solid solution and $Al_3Sc$ based precipitates are matched closely, then the precipitate particles are thermally stable at elevated temperatures. The foregoing results in an aluminum alloy with high strength at elevated temperatures.

DETAILED DESCRIPTION

The present invention is drawn to an aluminum based alloy having excellent mechanical properties and suitable for applications in temperature ranges between −420° F. to 573° F.

The aluminum alloy comprises aluminum (Al), scandium (Sc), gadolinium (Gd), zirconium (Zr), and preferably magnesium (Mg). In order to achieve higher strength and toughness for a wide temperature range from cryogenic to elevated temperatures, a desired microstructure of the material should have uniform distribution of fine coherent precipitates having lower diffusivity and lower interfacial energy in the aluminum matrix. The matrix should be solid solution strengthened. Solid solution alloying is beneficial to provide additional strengthening and greater work hardening capability. A material with a larger work hardening exponent would strain at higher level without causing any damage, resulting in improved failure strain and toughness.

Scandium is a potent strengthener in aluminum alloys and forms an $Al_3Sc$ precipitate with aluminum in the equilibrium condition. The $Al_3Sc$ has an $L1_2$ structure that is an ordered face centered cubic (FCC) structure with Sc atoms located in the corners and aluminum atoms on the cubic faces. The purpose of this invention is to produce a thermally stable microstructure by making the $Al_3Sc$ precipitate more resistant to coarsening at elevated temperatures through suitable alloying additions. In accordance with the present invention it has been found that gadolinium and zirconium both are excellent alloy elements for this purpose. Both gadolinium and zirconium are added as alloying elements with or without magnesium, preferably with magnesium.

It has been found that an aluminum alloy having the following composition is particularly useful for applications in the desired temperature range: 0.1 to 2.9 wt. % Sc, 2.1 to 20 wt. % Gd, 0.2 to 1.9 wt. % Zr, and preferably 1 to 7 wt. % Mg. In embodiments, the alloy may comprise: 0.6 to 2.9 wt. % Sc, 2.1 to 20 wt. % Gd, 0.2 to 1.9 wt. % Zr, and preferably 1 to 7 wt. % Mg.

Gadolinium forms $Al_3Gd$ precipitate with Al that is stable up to very high temperature (i.e., about 842° F.) due to its low diffusion coefficient in aluminum. $Al_3Gd$ precipitate has $DO_{19}$ structure in the equilibrium condition. It has been found that Gd substitutes with $Al_3Sc$ precipitate forming $L1_2$ ordered phase of $Al_3(Sc_x,Gd_{1-x})$ precipitate resulting in improved thermal and structural stability. Despite large atomic size, Gd has fairly high solubility in $Al_3(Sc_x,Gd_{1-x})$ precipitates.

It has been found that Zr forms $Al_3Zr$ precipitate that has an $L1_2$ structure in the metastable condition and $DO_{23}$ structure in the equilibrium condition. The $Al_3Zr$ precipitate is highly resistant to coarsening. Similarity in the nature of $Al_3Zr$ and $Al_3Sc$ precipitates would allow complete or partial intersolubility of these phases resulting in the $L1_2$ ordered $Al_3(Sc_xZr_{1-x})$ phase. The Al—Sc—Gd—Zr alloy would form $L1_2$ ordered precipitate of $Al_3(Sc,Gd,Zr)$ with improved thermal and structural stability which is believed to be due to reduced lattice mismatch between the aluminum matrix and the precipitate. Additionally, this modified $Al_3(Sc,Gd,Zr)$ precipitate is more resistant to dislocation shearing compared to $Al_3Sc$ precipitate, thereby improving mechanical properties of the alloy at room temperature.

While magnesium is not present in all embodiments of this invention, magnesium is a preferred alloying element because the magnesium: (1) increases the lattice parameters of aluminum, thereby improving the thermal stability of the resulting aluminum alloy, (2) provides substantial solid solution strengthening, and (3) decreases the density, and therefore the weight, of the resulting aluminum alloy. Without magnesium, the alloy won't be as strong as is it would be with magnesium, but in some embodiments, that may be acceptable.

In the present invention, the scandium addition can vary from about 0.1 to 2.9 wt. %, preferably about 0.6 to 2.9 wt. % in some embodiments, depending on the processing technique used for producing the material. The phase diagram of Al—Sc indicates an eutectic reaction at 0.5 wt. % of Sc and 1219° F. resulting in a mixture of aluminum solid solution and $Al_3Sc$ phase. The phase diagram also shows a steep liquidus for hypereutectic compositions. This suggests that casting techniques can be used for Sc composition only up to 0.5 wt. %. For hypereutectic compositions, i.e. Sc greater than 0.5 wt. %, rapid solidification techniques such as melt spinning, atomization or spray deposition utilizing higher cooling rates can be used to process the material. The amount of Sc that can be taken in supersaturation also depends on the cooling rate. Ideally one would like to keep all the Sc in solution to avoid formation of primary particles. Primary particles are usually large in size and therefore, not considered to be beneficial for mechanical properties. The higher limit of 2.9 wt. % Sc has been selected because atomization, the most common processing technique, can provide complete supersaturation of Sc up to 3 wt. %.

Gadolinium addition is from about 2.1 to 20 wt. % in the present invention. Although, Gd can be added as high as 20 wt. %, the amount of Gd addition should depend on the solubility of Gd in $Al_3Sc$ precipitate. The preferred composition of Gd would be equivalent to Sc level in terms of atomic percent so that Gd can substitute up to 50% in $Al_3(Sc_x,Gd_{1-x})$ precipitate. Since Al—Gd forms eutectic at 23 wt. % Gd composition, slower cooling rate process such as casting may be used for processing of the present alloy. However, rapid solidification technique will be preferred due to the presence of other elements and especially when they are present with hypereutectic compositions.

Zirconium is present from about 0.2 to 1.9 wt. % in the preferred alloy. In the present alloy, the role of Zr is that $Al_3Zr$ precipitate is substituted in $Al_3Sc$ precipitate to control the coarsening kinetics of the alloy. It has been found that Zr has good solubility in $Al_3Sc$ precipitate. While casting may be used with small Zr additions, rapid solidification will be preferred for larger Zr additions.

Magnesium is a preferred alloy element in accordance with some embodiments of the present invention in combination with Sc, Gd and Zr. While Mg can vary from about 1 to 7 wt. % in embodiments of the present alloy, it may be preferred to use about 4 to 6 wt. % of Mg to impart sufficient solid solution strengthening and increase in lattice constant to match with $Al_3Sc$ precipitate. If the amount of Mg is higher, it may form $Mg_5Al_8$ intermetallic particles that are deleterious to the mechanical properties of the alloy. Lower Mg content may not provide sufficient solid solution strengthening. Binary Al—Mg alloy is not a heat treatable alloy. However, it responds to heat treatment in the presence of Sc, Gd and Zr additions especially for cast alloys. Aging temperatures for the cast Al—Sc based alloys are usually very high 400-550° F., which is also indicative of the superior thermal stability of $Al_3Sc$ based precipitate.

The alloy of the present invention can be processed by any rapid solidification technique utilizing cooling rates in excess of $10^{3}$° C./s. The rapid solidification process includes melt spinning, splat quenching, atomization, spray deposition and laser melting. The particular processing technique is not important. The most important aspect is the cooling rate of the process. A higher cooling rate is required for the alloy with larger amount of solute additions. These processes produce different forms of the product such as ribbon, flake or powder. Atomization is the most commonly used rapid solidification technique to produce a large volume of powder. The cooling rate experienced during atomization depends on the powder size and usually varies from $10^3$-$10^{5}$° C./s. Finer size (−325 mesh) of powder is preferred to have maximum supersaturation of alloying elements that can precipitate out during compaction and extrusion of powder. Powders of various invented alloys were produced using helium gas atomization. Helium gas provides higher heat transfer coefficient leading to higher cooling rate in the powder. The ribbon or powder of alloy can be compacted using vacuum hot pressing, hot isostatic pressure or blind die compaction after suitable vacuum degassing. Compaction takes place by shear deformation in vacuum hot pressing and blind die compaction, whereas diffusional creep is key for compaction in hot isostatic pressing. Vacuum hot pressing was used for compaction of the present alloy. The alloy is further extruded, forged or rolled to impart deformation. This step is important to achieve the highest mechanical properties. Although lower extrusion ratios may be useful, it is preferred to use extrusion ratios in the range of about 10:1 to 25:1. The present alloy was extruded using a 22:1 ratio. The temperature for vacuum degassing, vacuum hot pressing, extrusion, forging and rolling can be in the range of about 572-842° F.

The alloy powder of the present invention can also be produced using mechanical alloying (U.S. Pat. No. 3,816,080) or cryomilling (U.S. Pat. Nos. 4,599,214 and 4,601,650) where powder is milled using high energy ball milling at room temperature or at cryogenic temperature in liquid nitrogen environment. While both mechanical alloying and cryomilling processes can provide supersaturation of alloying elements, cryomilling is preferred because it has less oxygen content. Cryomilling introduces oxynitride particles in the grains that can provide additional strengthening to the alloy at high temperature by increasing threshold stress for dislocation climb. In addition, the nitride particles when located on grain boundaries can reduce the grain boundary sliding in the alloy by pinning the dislocation resulting in reduced dislocation mobility in the grain boundary.

The alloy powder can also be used for making components using vacuum plasma spray or cold spray processes. In vacuum plasma spray (VPS), the powder particle is melted and deposited onto the substrate resulting in a highly dense product. In cold spray process, the powder is ejected from the nozzle at very high velocity and deposited onto the substrate without melting the powder. While either of these processes can be used for the invented alloy, cold spray is preferred because it does not melt the powder, thereby retaining the original microstructure of the powder.

The alloy may also be produced using casting processes such as squeeze casting, die casting, sand casting, and permanent mold casting provided the alloy contains small amount of Sc, Gd and Zr additions.

The following alloy compositions have been produced using a powder metallurgy process: Al-6Mg-2Sc-1Gd-1Zr, Al-6Mg-1Sc-1Gd-1Zr, Al-6Mg-1Sc-1.5Gd-0.5Zr and Al-6Mg-1Sc-1Gd-0.5Zr (wt. %). The powder metallurgy process used for these alloys consisted of atomization, vacuum degassing, vacuum hot pressing and extrusion. These alloys showed a good combination of strength and ductility at ambient temperature. The above alloy compositions provide good strength at elevated temperatures. Additional alloy compositions for improvement in elevated temperature capability are as follows: (a) Al-6Mg-2.8Sc-6Gd-1.8Zr, (b) Al-6Mg-2.8Sc-12Gd-1.8Zr, and (c) Al-6Mg-2.8Sc-18Gd-1.8Zr (wt. %). These alloys were produced using the powder metallurgy technique as described above.

The alloy of the present invention can be used in monolithic form or can contain continuous or discontinuous reinforcement second phase to produce metal-matrix composite. Suitable reinforcement materials include oxides, carbides, nitrides, oxynitrides, oxycarbonitrides, silicides, borides, boron, graphite, ferrous alloys, tungsten, titanium and mixtures thereof. Specific reinforcing materials include SiC, $Si_3N_4$, Boron, Graphite, $Al_2O_3$, $B_4C$, $Y_2O_3$, $MgAl_2O_4$, TiC, $TiB_2$ and mixtures thereof. These reinforcing materials may be present in volume fractions of up to about 50 vol. % and preferably 0.5-50 vol. % and more preferably 0.5-20 vol. %.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An aluminum alloy consisting of about 0.1 to 2.9 wt. % Sc, about 2.1 to 20 wt. % Gd, about 1 to 7 wt. Mg, and from greater than 0.5 up to about 1.9 wt. Zr, balance essentially aluminum.

2. An aluminum alloy according to claim 1, wherein the alloy comprises an aluminum solid solution matrix and a dispersion of $Al_3X$ having an $L1_2$ structure where X comprises Sc, Gd and Zr.

3. An aluminum alloy according to claim 1, wherein the alloy comprises about 0.6 to 2.9 wt. % Sc.

4. An aluminum alloy according to claim 3, wherein the alloy comprises an aluminum solid solution matrix and a dispersion of $Al_3X$ having an $L1_2$ structure where X comprises Sc, Gd and Zr.

* * * * *